US005297938A

United States Patent [19]

Von Essen et al.

[11] Patent Number: 5,297,938

[45] Date of Patent: Mar. 29, 1994

[54] HYDROFOIL IMPELLER

[75] Inventors: John A. Von Essen, Palmyra; Ronnie G. Thompson, Annville; Ravi K. Sharma; Edward C. Schrom, both of Palmyra, all of Pa.

[73] Assignee: Philadelphia Mixers Corporation, Palmyra, Pa.

[21] Appl. No.: 855,121

[22] Filed: Mar. 18, 1992

Related U.S. Application Data

[63] Continuation of Ser. No. 498,843, Mar. 26, 1990, abandoned.

[51] Int. Cl.[5] ..... B01F 7/20

[52] U.S. Cl. ..... 416/237; 416/243; 366/343; 366/330

[58] Field of Search ..... 416/223 R, 235, 237, 416/238, 242, 243, DIG. 3, DIG. 5; 366/330, 343; 29/889, 889.3, 889.7

[56] References Cited

U.S. PATENT DOCUMENTS

| | | | |
|---|---|---|---|
| 2,659,581 | 11/1953 | Gray | 416/238 |
| 3,166,303 | 1/1965 | Chapman | 366/343 |
| 3,333,831 | 8/1967 | Chapman | 366/343 |
| 4,054,272 | 10/1977 | Cooke | 366/343 |
| 4,147,437 | 4/1979 | Jonqueres | 416/243 |
| 4,468,130 | 8/1984 | Weetman | 416/243 |
| 4,571,090 | 2/1986 | Weetman et al. | 366/343 |
| 4,721,394 | 1/1988 | Casto et al. | 416/243 |
| 5,046,245 | 9/1991 | Weetman et al. | 29/889 |
| 5,073,033 | 12/1991 | Klepeis | 416/237 |

FOREIGN PATENT DOCUMENTS

| | | | |
|---|---|---|---|
| 46659 | 11/1984 | Japan | 366/343 |
| 857921 | 1/1961 | United Kingdom | 29/889 |
| 950335 | 2/1964 | United Kingdom | 416/237 |

*Primary Examiner*—Edward K. Look
*Assistant Examiner*—James A. Larson
*Attorney, Agent, or Firm*—William H. Murray

[57] ABSTRACT

A hydrofoil impeller includes three impeller blades attached to a hub. Each impeller blade includes a flat section and a curved section which terminates in a tip portion. The flat section has a root portion proximate the hub and which forms a predetermined root angle with respect to a plane perpendicular to the vertical axis of the impeller. The curved section is separated from the flat portion by a bend line. The curved section is bent downwardly from the plane of the flat section along the bend line. The bend line is oriented with respect to the impeller blade such that the blade tip angle is changed as the bend is formed. Accordingly, the bend is used to set the proper tip angle. The blade angle increases from the tip inward to the bend line, then becomes a constant where attached to the hub. The camber increase from the tip inward to the bend line, then falls to zero where attached to the hub.

6 Claims, 4 Drawing Sheets

HYDROFOIL IMPELLER

This is a continuation of copending application Ser. No. 07/498,843 filed on Mar. 26, 1990 abandoned.

BACKGROUND OF THE INVENTION

The present invention relates to mixing apparatus and more particularly to impellers for use in such mixing apparatus.

Such mixing apparatus employs an impeller to impart flow and turbulence to a fluid medium in order to produce in such medium the stirring of a mixture, an aeration, a mixing or dispersive action. It is known that high efficiency liquid pumping action may be facilitated by the use of an impeller having blades with a hydrofoil shape. Such impellers have been fabricated from plates, such as disclosed in U.S. Pat. No. 4,147,437, issued Apr. 3, 1979. Such impellers may additionally have pitched blades in which the blade angle with respect to a plane perpendicular to the shaft increases from the tip to the base; and at least the outer portion of the blades have a camber as depicted in FIG. 5.

The methods used to construct pitched blade hydrofoil impellers have been complex and expensive. Even those impellers utilizing blades fabricated from plates are relatively difficult to manufacture. Much of this difficulty is attributable to the fact that the blades must not only be formed to a predetermined hydrofoil shape, the hub angle and tip angles must be precisely established since such have a significant impact on the performance of the impeller. One method of constructing such an impeller utilizes ears attached to the impeller hub at a predetermined hub angle. The desired root angle is established when the root of the impeller blade is attached to the ear. However, even though root angle may be precisely established in this manner, a final twist operation is frequently required to achieve an accurate tip angle. Such a fabrication process frequently requires multiple twist operations in order to finally establish the correct tip angle with respect to the root angle established by the hub ear. Another, but considerably more expensive process, entails casting the impeller utilizing a mold having accurately established root and tip angles.

It is known that input power spikes can occur when the level of the liquid in which the impeller is immersed approaches the level of the impeller blades, while raising or lowering the liquid level. An impeller having drooping blades was found to reduce or eliminate this power spike. The blade droop has been obtained by using downward angled hub ears to which the blades are attached, which is an expensive option. In another configuration, the blades are set at a severe angle to the hub ear such as, for example, shown in U.S. Pat. No. 4,147,437, FIG. 6. The disadvantages of these types of constructions include increased expense and difficulty of attaining accurate tip angles.

Accordingly, it is an object of the present invention to provide an impeller having a high efficiency liquid pumping action and enhanced power stability.

It is another object of the present invention to provide an impeller having low power requirements for a given speed and diameter.

It is yet another object of the present invention to provide an impeller having blades which are relatively easily manufactured.

It is a further object of the present invention to provide an impeller having blades which may be formed from cut plate with an accurate tip angle produced.

SUMMARY OF THE INVENTION

Briefly described, the impeller of the present invention comprises a hub having at least one impeller blade attached to it. The impeller blade is of substantially constant thickness and includes a flat section and a curved section which terminates in a tip portion. The flat section has a root portion proximate the hub and which forms a predetermined root angle with respect to a plane perpendicular to the vertical axis of the impeller. The curved section is separated from the flat portion by a bend line. The curved section is bent downwardly from the plane of the flat section along the bend line. The bend line is oriented with respect to the impeller blade such that the blade tip angle is changed as the bend is formed. Accordingly, the bend is used to set the proper tip angle. The blade angle increases from the tip inward to the bend line, then becomes a constant where attached to the hub. The camber increases from the tip inward toward bend line, then falls to zero at the bend line and remains zero where attached to the hub. In another embodiment, the camber decreases from the tip inward.

The foregoing and other objects, features and advantages of the invention will become apparent from the following detailed description when read in connection with the accompanying drawings in which:

DETAILED DESCRIPTION OF THE PREFERRED EMBODIMENT

Figure 1:
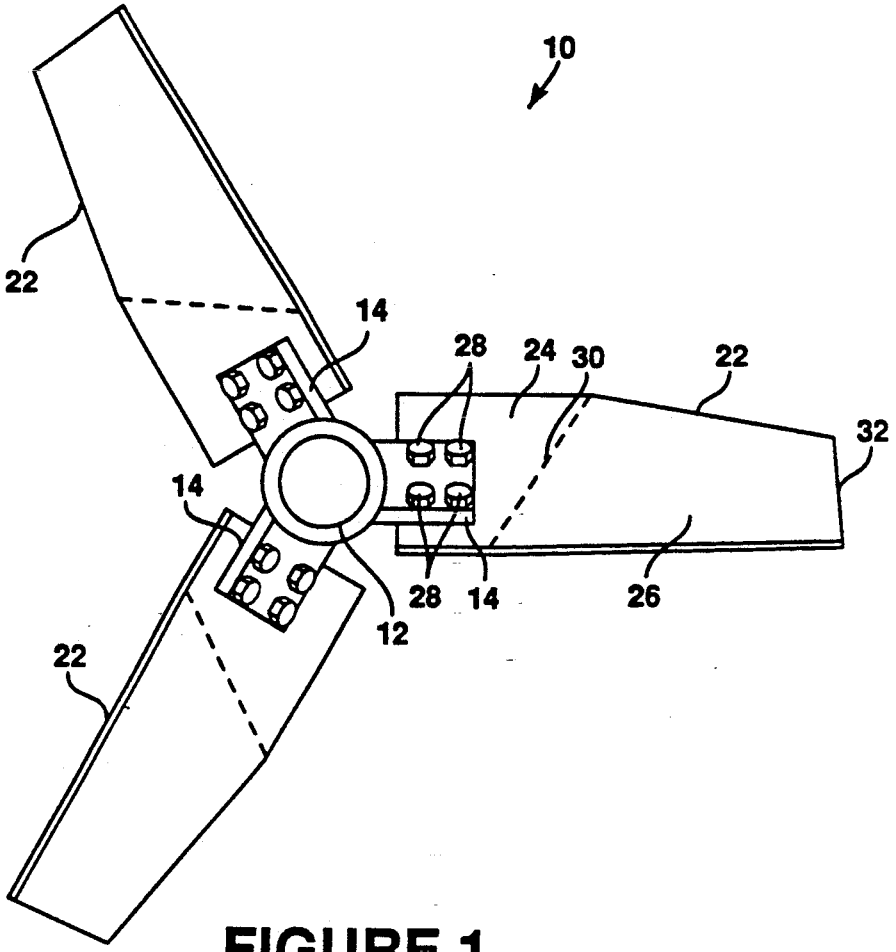
FIG. 1 is a top plan view of an impeller in accordance with the present invention.
Figure 2:
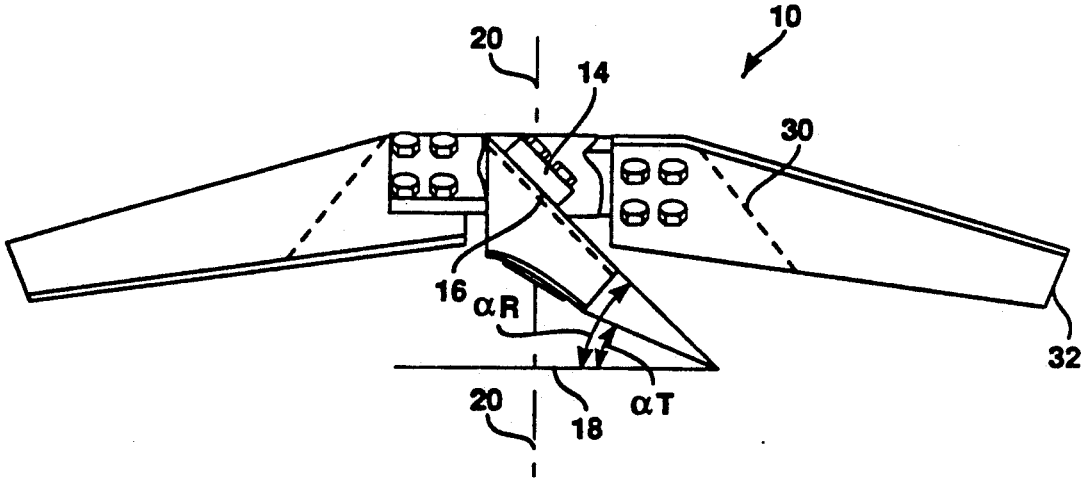
FIG. 2 is a side elevational view of the impeller depicted in FIG. 1.

Referring now to FIG. 1 there is shown an impeller in accordance with a preferred embodiment of the present invention, generally designated 10. The impeller 10 includes a hub 12. Three ears 14 are attached to the hub 12, preferably by welding. In the preferred embodiment, each ear has a substantially planar lower mating surface 16 (see FIG. 2). Each ear 14 is positioned on the hub such that the lower mating surface 16 forms a predetermined root angle $\alpha_R$ with respect to a plane 18 which is substantially perpendicular to the vertical axis 20 of the impeller 10 as shown in FIG. 2.

An impeller blade 22 having a flat section 24 and curved section 26 is attached to each ear 14. In the preferred embodiment, the upper surface of the flat section 24 is maintained in contacting relationship with the mating surface of the ear 14 by means of bolts 28. The flat section 24 forms a substantially planar root portion of the impeller blade 22. Consequently, since the mating surface 16 of the ear 14 is disposed at the predetermined root angle $\alpha_R$, the root portion of the impeller blade 22 is thereby maintained at the predetermined root angle $\alpha_R$ by virtue of its attachment to the ear 14.

The boundary between the flat section 24 and the curved section 26 is a bend line. The bend line is represented by the dotted line 30 in FIGS. 1 and 2. The curved section 26 of the impeller 22 is bent downwardly with respect to the flat section 24 along the bend line 30. The bend line 30 is oriented such that a predetermined tip angle $\alpha_T$ is formed between the tip 32 of the blade 22 and the plane 18 (see FIG. 2) as will be subsequently described. A blade tip angle as low as 7.5° can be used. A minimum blade tip angle of 12° is also useable.

Figure 4:
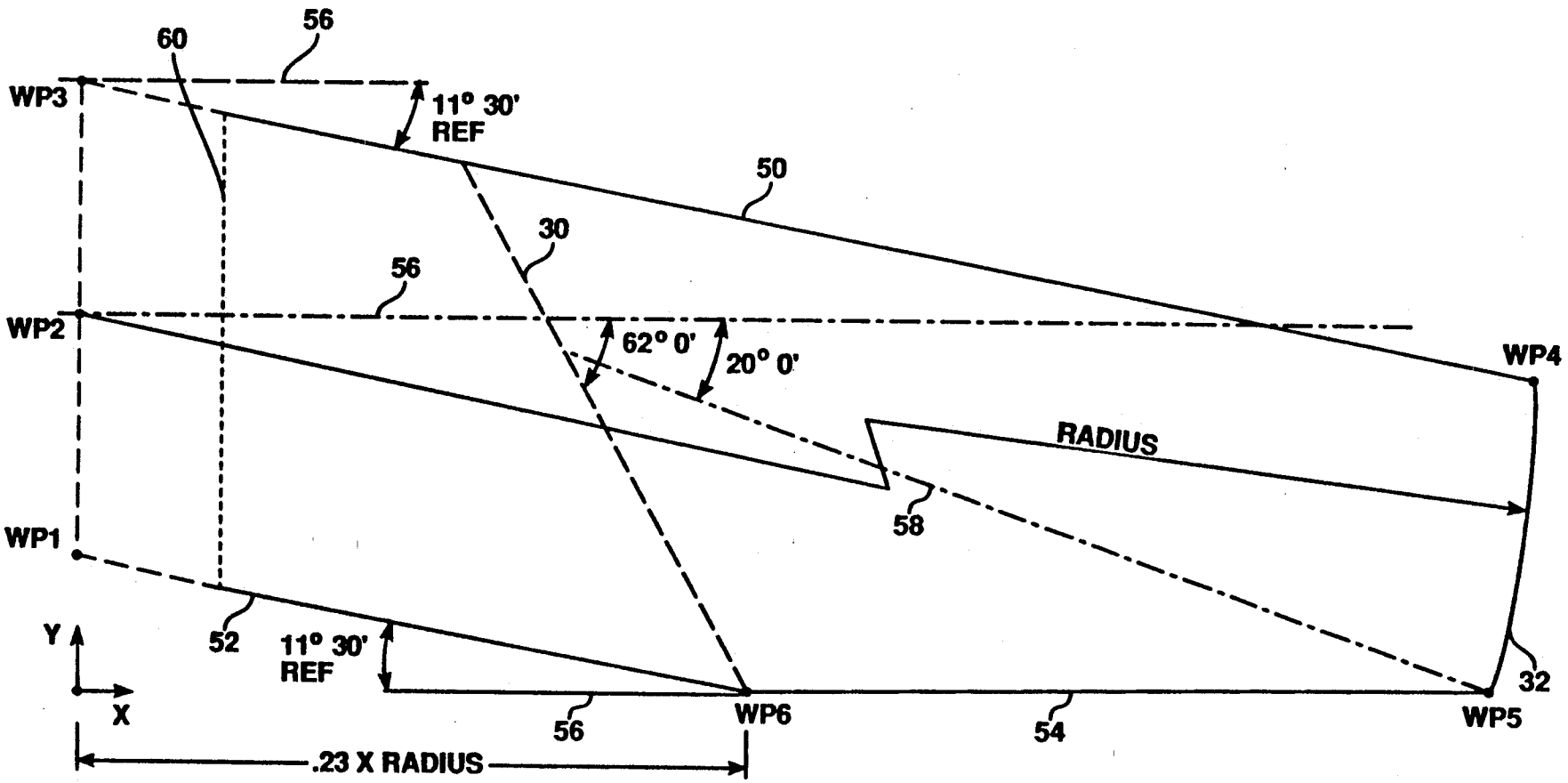
FIG. 4 is a plan view of a template of an impeller blade in accordance with the present invention.

Each impeller blade is preferably fabricated as follows. Flat sheet stock is cut to the exact shape and size of the template, which is shown in FIG. 4. The template is characterized by several key parameters, chief among them are work points (WP). Work points are an aid in describing and cutting the blade; they are the points of intersection of the various edges of the blade. The work points are located with respect to an X-Y coordinate origin (see FIG. 4). Work points 1, 2 and 3 are on the Y (vertical axis); work points 5 and 6 are on the X (horizontal) axis. The leading edge 50 is between work points 3 and 4, and makes an angle of preferably 11.5° with the horizontal.

The inner portion 52 of the trailing edge 54, between work points 1 and 6, also makes an angle of preferably 11.5° with the horizontal 56, whereas the outer portion of the trailing edge is parallel to the X axis. Work point 6 is at the intersection of these two portions and is separated from the Y axis by a distance equal to preferably 23% of the impeller radius. The tip 32 of the blade is an arc of radius equal to one half of the impeller diameter, subtended by work points 4 and 5, and with center at work point 2. Work point 2 is the midpoint of the blade width, which is bounded by work points 1 and 3, and is equal to length to 16% of the diameter.

Figure 5:
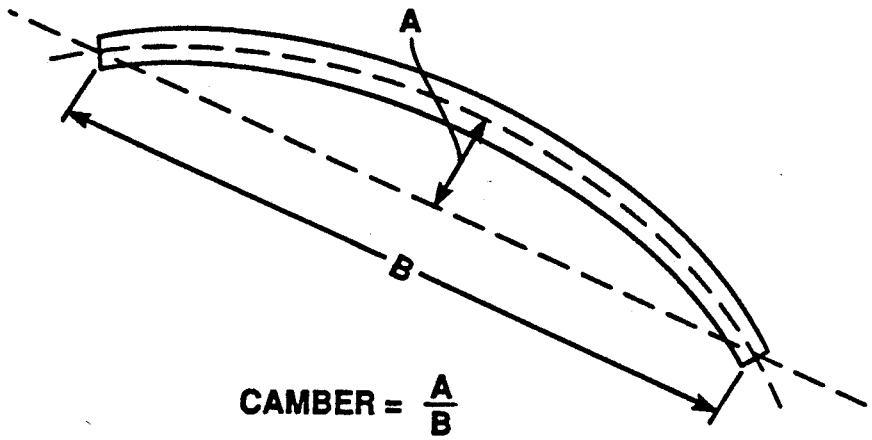
FIG. 5 is an end view of an impeller blade depicting camber.

After the flat stock is cut to the shape and size of the template, it is preferably formed as follows. Uni-axial curvature is imparted to the outer portion of the blade along a roll axis 58, which passes through work point 5 and makes an angle of preferably 20° with the horizontal 56, as shown in FIG. 4. The curvature varies from a radius preferably equal to one third of the impeller diameter at the blade tip 32, remaining constant from the tip inward toward the bend line 30, then dropping quickly to zero at the bend line 30. As shown in FIG. 5, the camber is defined as the maximum height A of the curvature of the blade above the chord line B divided by the length of the chord line B. In the preferred embodiment of the present invention, the camber increases from the tip of 32 of the blade toward the bend line 30. Utilizing the method the present invention, it is also possible to construct an impeller blade wherein the camber decreases from the tip inward as described in U.S. Pat. No. 4,468,130. After rolling, if the blade were laid concave side up on a flat surface, all work points except 4 would be on the surface; due to curvature, work point 4 would be raised.

Figure 3C:
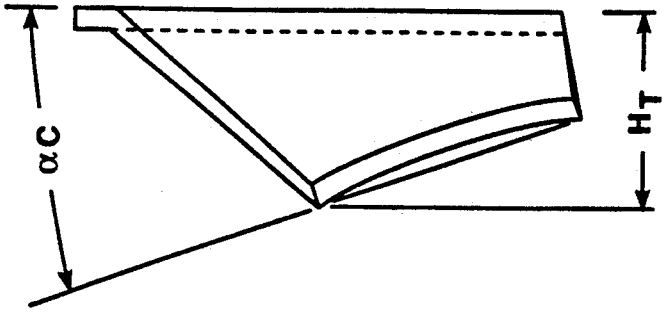
FIG. 3C is an end view of the geometry of an impeller blade formed in accordance with present invention.

After rolling, the blade is bent along the bend line 30, which makes an angle of preferably 62° with the horizontal 56, as shown in FIG. 4. The outer portion is bent upward until a specified tip height $H_T$ (see FIGS. 3B and 3C) is obtained. The tip height $H_T$ is preferably 10% of the impeller diameter. Simultaneously, a specified chord angle is obtained at the blade tip 32, this being the angle between the chord that connects work points 4 and 5, and the flat surface. The chord angle is preferably 22.5°. The chord angle $\alpha_C$ is the difference between the root angle and the tip angle, $\alpha_R - \alpha_C$. It is the chord angle, easily achieved during formation of the blade, that determines the specified impeller tip angle, $\alpha_T$, when the blade is attached to a hub ear. After the bend line is formed, the chord angle may be measured and additional bending along the bend line can correct the chord angle to the specified preferred 22.5°. It is very difficult to achieve a specified tip angle simply by rolling. The bend line allows corrective bends to be made, the entire process thus being done in less time than if additional rolling were the only correction. This lesser production time results in lower cost. The tip angle $\alpha_T$ can be as low as 7.5°. Below a tip angle $\alpha_T$ of 7.5°, the angle of attack $\alpha_A$ falls below zero, which will produce some inefficient flow in the wrong direction. In a preferred embodiment, the tip angle is 22.5°. In an alternate preferred embodiment, the tip angle is 9.5°.

Figure 3A:
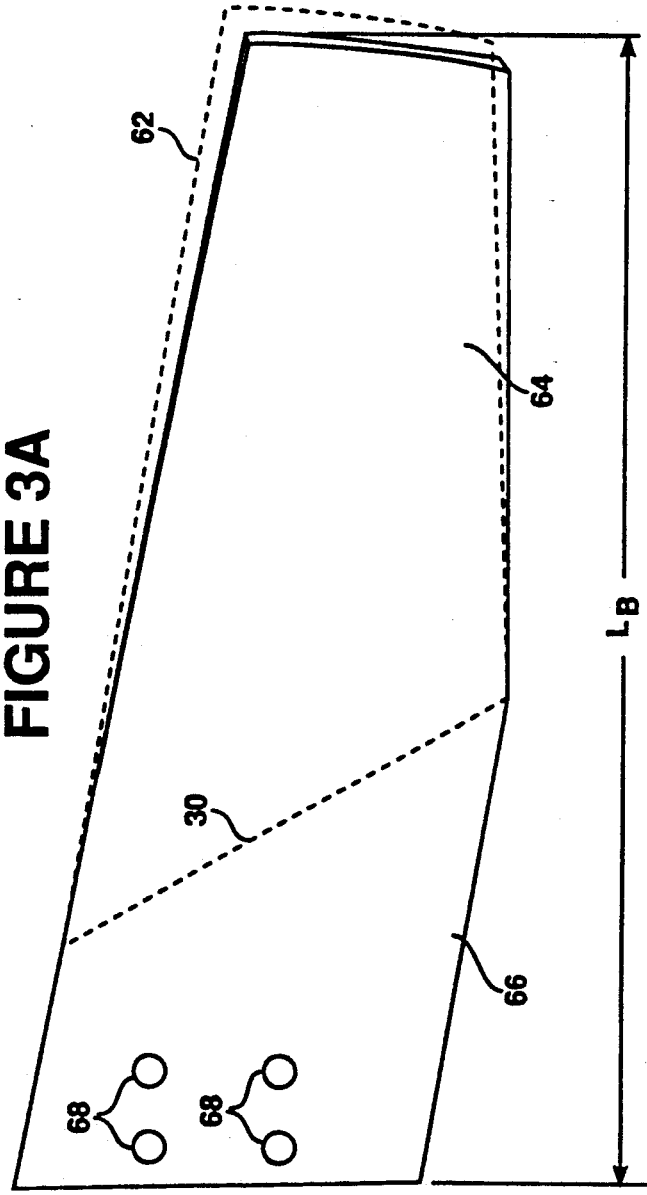
FIG. 3A is a plan view of the geometry of an impeller blade formed in accordance with the present invention.
Figure 3B:
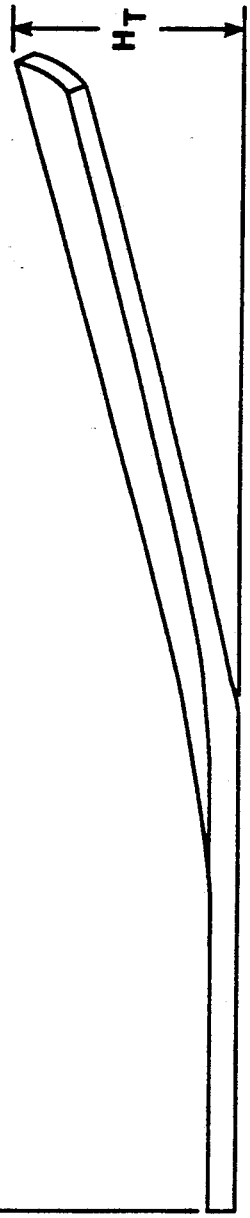
FIG. 3B is a side elevational view of the geometry of an impeller blade formed in accordance with the present invention.

After bending, the blade is positioned on a flat surface and the precise location of its inner edge 60 is determined. As shown in FIG. 3A, the rolling and bending operations shorten the blade in the plan view. The dotted line 62 in FIG. 3A depicts the outline of the blade before rolling and bending. The portion 64 to the right of the bend line 30 as shown in FIG. 3A is the rolled part of the blade depicted with the concave side up. The portion 66 to the left of the bend line 30 as depicted in FIG. 3A is the flat part of the blade. The length of the finished blade is depicted as dimension line $L_B$ in FIGS. 3A and 3B. By locating the inner edge 60 after forming, the correct blade length is assured. After the inner edge 60 is cut the bolt holes 68 are located and drilled. The holes will be used for bolting the blade to a hub ear as shown in FIGS. 1 and 2.

As can be seen from the above detailed description, the impeller blade of the present invention can be manufactured at low cost by means of a properly located final bend line. In addition, the blade tip angle may be set accurately and easily by means of the final bend line. Furthermore, the impeller blades droop by means of the final bend line, thereby avoiding power spikes at a fluid surface. The impeller blades each have a low camber at the blade tip and an accurately controlled tip angle which can be as low as 7.5° to the horizontal, producing a very low power response. Also, the impeller can be easily constructed utilizing blades have a leading edge with an angle of 11.5° to the horizontal, a trailing edge parallel to the horizontal on its outer portion and 11.5° to the horizontal on its inner portion, a bend line terminating on the trailing edge at a distance substantially equal to 23% of the impeller radius, the roll axis of the impeller at a 20° angle to the horizontal, the bend line at a 62° angle to the horizontal with the final tip angle 22.5° from the root angle.

While the present invention has been described with reference to a specific embodiment thereof, it will be obvious to those skilled in the art that various changes and modifications may be made without departing from the invention in its broader aspects. It is contemplated in the appended claims to cover all variations and modifications of the invention that come within the true spirit and scope of our invention.

We claim:

1. An impeller for mixing fluid in a vessel, which comprises a hub and a plurality of blades mounted on said hub, each blade formed of a plate of substantially constant thickness and a camber which increases from the tip of the blade inward toward a bend line, beyond which the blade is flat, and a blade angle which increases from the tip inward to said bend line, beyond which the angle is constant.

2. An impeller according to claim 1 wherein the blade tip angle is set by means of a final bend along said bend line.

3. An impeller according to claim 2 wherein the blade droops by means of said bend line, thereby avoiding power spikes at a fluid surface.

4. An impeller according to claim 3 wherein said tip angle has a magnitude in a range of from approximately 7.5° to approximately 22.5°.

5. An impeller according to claim 1 wherein each blade has a leading edge with an angle of substantially 11.5° with respect to a horizontal reference line, a trailing edge having an inner portion and an outer portion, said outer portion parallel to said horizontal reference line and said inner portion forming an angle of substantially 11.5° with respect to said horizontal reference line, said bend line terminating on said trailing edge at a distance substantially equal to 23% of the impeller radius, a roll axis having an angle substantially equal to 20° with respect to said horizontal reference line, and said bend line having an angle of approximately 62° with respect to said horizontal reference line, and a tip angle approximately equal to 22.5°.

6. A blade for use in an impeller for mixing fluid in a vessel, which blade is formed of a plate of substantially constant thickness and including a camber which increases from the tip of the blade toward a bend line, beyond which the blade is flat, and a chord angle which decreases from the tip inward to said bend line, beyond which the chord angle is zero.

* * * * *